US007608123B2

(12) United States Patent
Pineschi

(10) Patent No.: US 7,608,123 B2
(45) Date of Patent: Oct. 27, 2009

(54) VACUUM CLEANER

(76) Inventor: Massimiliano Pineschi, Strada Villanova, 94/A, Villanova (MO) (IT) I-41010

( * ) Notice: Subject to any disclaimer, the term of this patent is extended or adjusted under 35 U.S.C. 154(b) by 581 days.

(21) Appl. No.: 10/543,064

(22) PCT Filed: Jan. 26, 2004

(86) PCT No.: PCT/EP2004/000624

§ 371 (c)(1),
(2), (4) Date: Jul. 21, 2005

(87) PCT Pub. No.: WO2004/064591

PCT Pub. Date: Aug. 5, 2004

(65) Prior Publication Data

US 2006/0048491 A1 Mar. 9, 2006

(30) Foreign Application Priority Data

Jan. 24, 2003 (IT) ..... MO2003A0012

(51) Int. Cl.
*B01D 46/00* (2006.01)

(52) U.S. Cl. ..... 55/429; 55/430; 55/466; 55/DIG. 3; 15/348; 15/349

(58) Field of Classification Search ..... 55/320, 55/323, 428, 429, 430, 466, DIG. 3
See application file for complete search history.

(56) References Cited

U.S. PATENT DOCUMENTS

| | | | | |
|---|---|---|---|---|
| 2,283,836 | A | 5/1942 | White | |
| 2,895,564 | A * | 7/1959 | Borie, Jr. | 55/409 |
| 3,909,222 | A * | 9/1975 | Caughlin et al. | 55/317 |
| 3,942,842 | A * | 3/1976 | Young, Jr. | 406/53 |
| 4,277,265 | A * | 7/1981 | Leinfelt | 55/302 |
| 6,171,375 | B1 | 1/2001 | Howie | |
| 6,238,451 | B1 * | 5/2001 | Conrad et al. | 55/323 |
| 6,260,234 | B1 * | 7/2001 | Wright et al. | 15/353 |
| 7,171,725 | B2 * | 2/2007 | Sjoberg et al. | 15/348 |

FOREIGN PATENT DOCUMENTS

| | | |
|---|---|---|
| EP | 1 033 102 | 9/2000 |
| JP | 55-52728 | 4/1980 |
| JP | 04-370030 | * 12/1992 |
| WO | WO 02/54928 | * 1/2002 |

OTHER PUBLICATIONS

International Search Report for PCT/EP2004/000624 dated Oct. 27, 2004.

(Continued)

*Primary Examiner*—Duane Smith
*Assistant Examiner*—Sonji Turner
(74) *Attorney, Agent, or Firm*—Themis Law

(57) ABSTRACT

A vacuum cleaner comprises a collection chamber located along an intended path through which air current and detritus is conveyed, said collection chamber being provided with a collection zone in which said detritus is receivable, wherein said collection chamber is provided with a compacting device movable across said collection zone for compacting said detritus.

12 Claims, 4 Drawing Sheets

OTHER PUBLICATIONS

Patent Abstracts of Japan, vol. 0031, No. 26 (M-077), Oct. 20, 1979—JP 54-103262, Aug. 14, 1979; abstract, figure.
Patent Abstracts of Japan, vol. 0030, No. 42 (M-055), Apr. 12, 1979—JP 54-19558, Feb. 14, 1979; abstract, figures.
Patent Abstracts of Japan, vol. 0030, No. 49 (M-057), Apr. 26, 1979—JP 54-26064, Feb. 27, 1979; abstract, figures.
Patent Abstracts of Japan, vol. 0030, No. 49 (M-057), Apr. 26, 1979—JP 54-28460, Mar. 3, 1979; abstract, figures.
Patent Abstracts of Japan, vol. 0061, No. 49 (C-118), Aug. 10, 1982—JP 57-71619, May 4, 1982; abstract, figures.
Patent Abstracts of Japan, vol. 0031, No. 20 (M-075), Oct. 9, 1979—JP 54-94759, Jul. 26, 1979; abstract, figures.

* cited by examiner

FIG 2
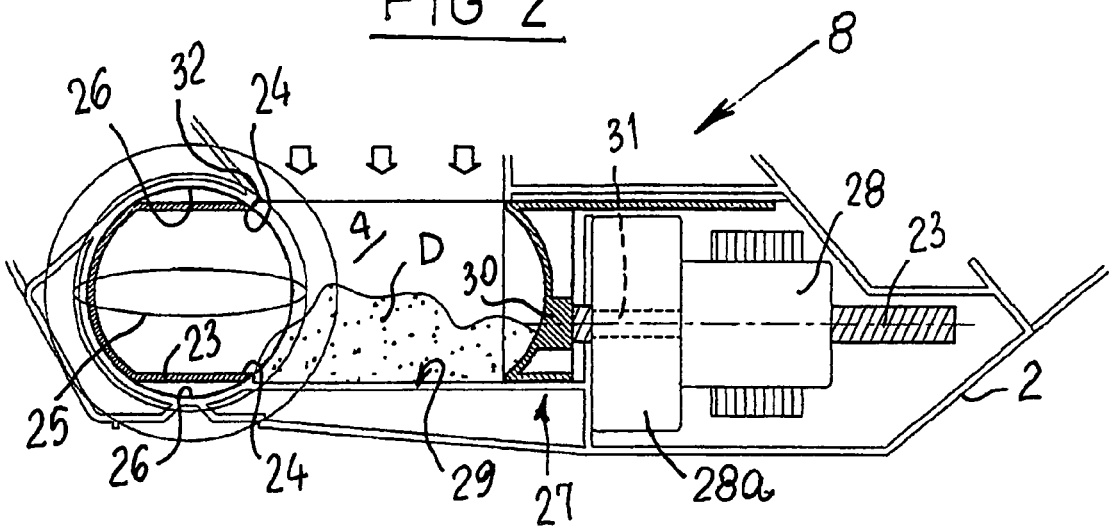
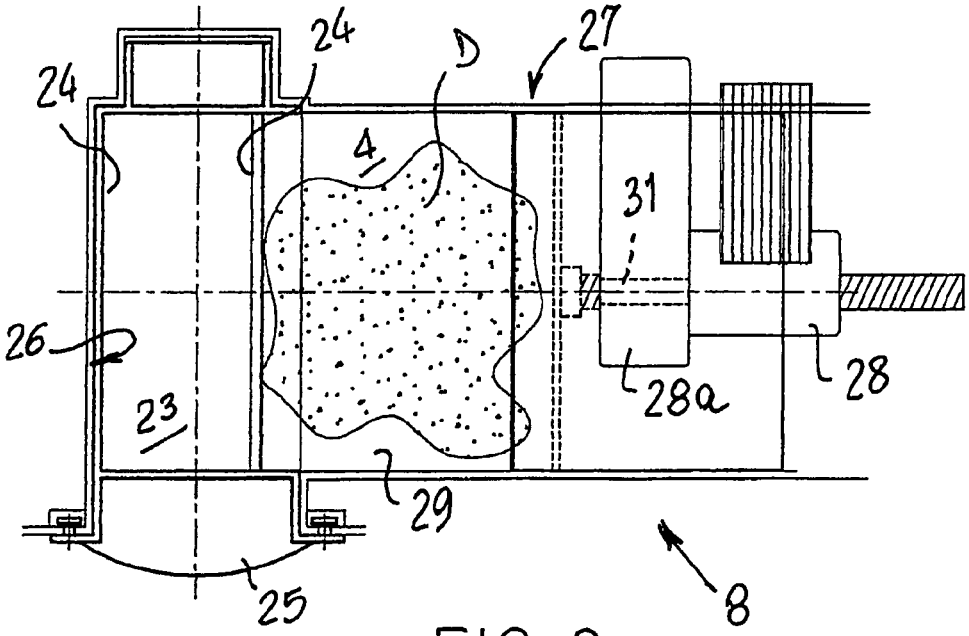
FIG. 3

FIG. 4
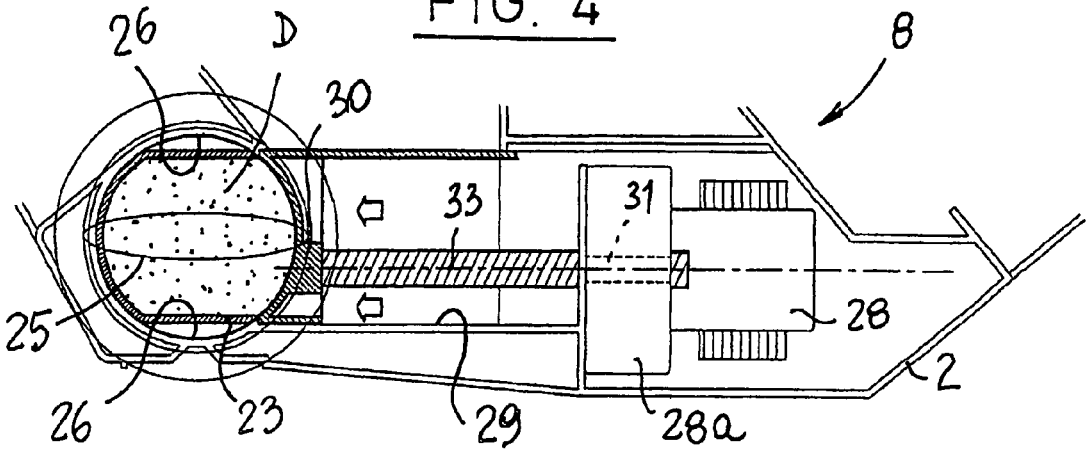
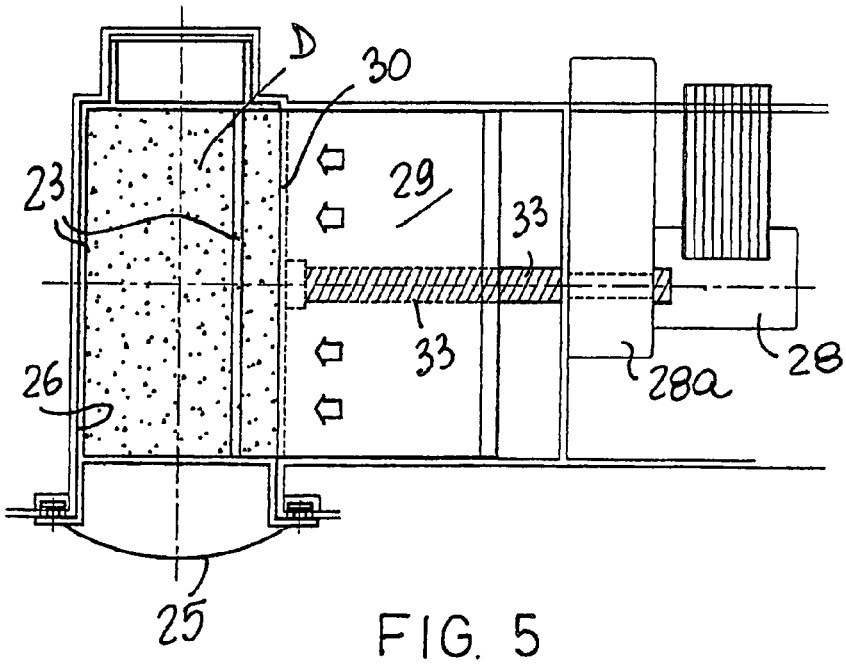
FIG. 5

FIG. 6
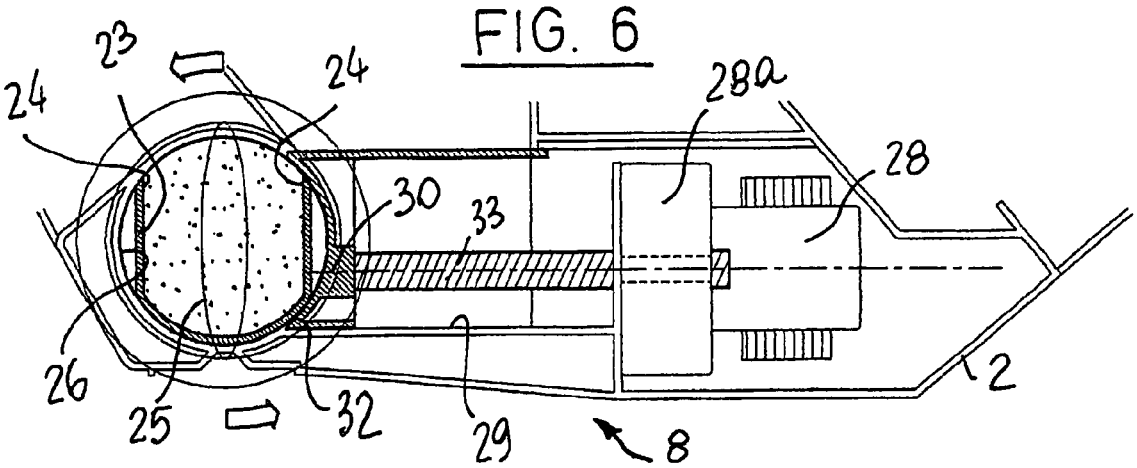
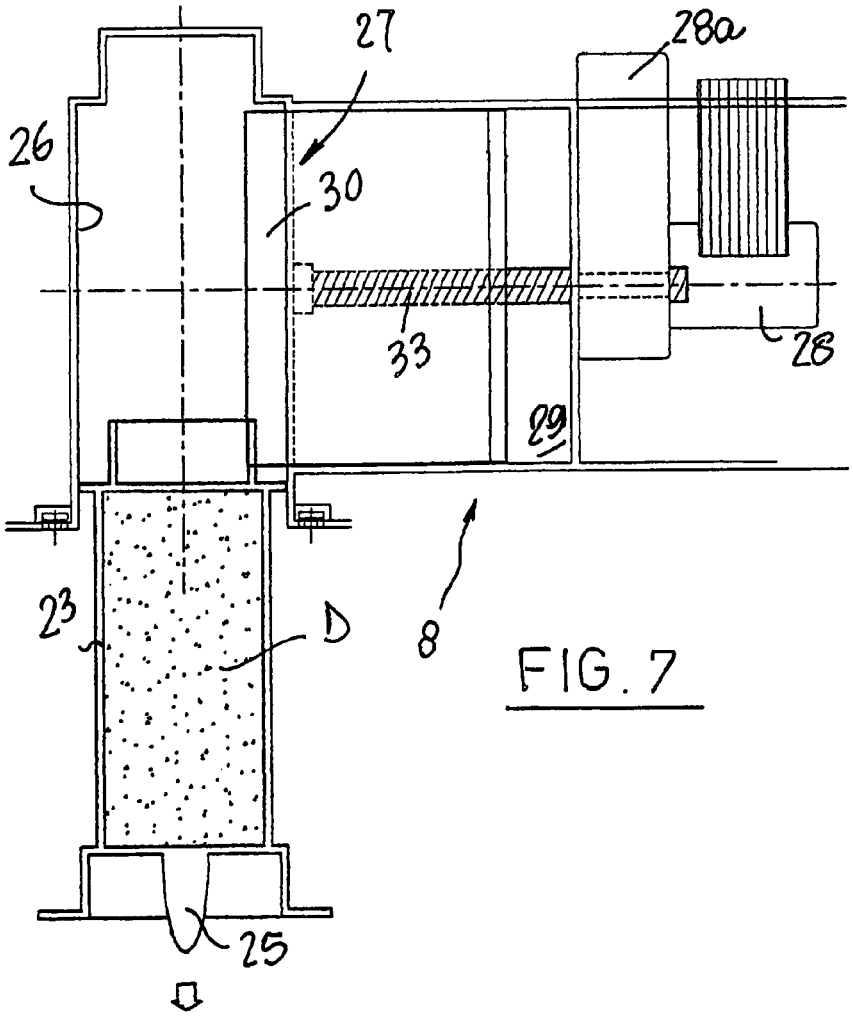
FIG. 7

VACUUM CLEANER

This application is the US national phase of international application PCT/EP2004/000624 filed 26 Jan. 2004 which designated the U.S. and claims benefit of IT MO2003A000012, filed 24 Jan. 2003, the entire contents of each of which are hereby incorporated by reference.

The present invention concerns an improved vacuum cleaner.

Vacuum cleaners of the prior art can basically be divided into three distinct types, according to their constructional and operating characteristics: in a first type, detritus is collected in bags located inside an enclosure body; in a second type, detritus is collected in a collection chamber of the enclosure body (so-called bagless vacuum cleaners); in a third type, a water tank is provided inside of the enclosure body so that air current containing detritus is introduced in the water and bubbles thereby releasing detritus in the water; thus, the air current leaving the water tank is free of pollutants and dusts and is returned to the environment.

The vacuum cleaners listed above have drawbacks as outlined below.

In vacuum cleaners of the first type, the bags progressively fill up with detritus thereby increasing their volume and tend to block an inlet of a suction channel through which air is sucked; this progressive blocking, in addition to reducing the efficiency of the vacuum cleaner, overheats the motor.

Furthermore, removal of full bags to perform the necessary periodical replacement with empty ones causes undesirable dispersion of dust in the environment.

Furthermore, each bag has a specific cost that is completely lost when it is disposed of as refuse.

In bagless vacuum cleaners, it is necessary to open the enclosure body to access the collection chamber, which causes a considerable dispersion of dust in the environment.

In vacuum cleaners of the third type, the water tank is somewhat expensive, and requires frequent cleaning to avoid putrescence arising from dirt stagnating in the water bath.

Purifying the air current which is introduced in the environment after suction is generally considered as a demand of the consumers.

An object of the invention is to improve known vacuum cleaners.

A further object is to substantially eliminate the prior-art drawbacks described above.

Another object is devising a vacuum cleaner that does not require, for the collection of detritus, water tanks or disposable bags.

Still another object is to provide a vacuum cleaner in which, during removal of the collected detritus dispersion of dust into the surrounding environment is substantially reduced.

Still a further object is to provide a vacuum cleaner in which efficient purification of the air current that is returned to the environment is substantially achieved.

According to the invention, there is provided a vacuum cleaner according to one or more of the appended claims.

Further characteristics and advantages of this invention will be clearer from the detailed description of a preferred but not exclusive embodiment of an improved vacuum cleaner, illustrated by way of non-limiting example in the attached drawings wherein:

FIG. 2 is a section taken along a plane II-II of FIG. 1, during a collection phase in which detritus is collected;

FIG. 3 is a plan view of FIG. 1;

FIG. 4 is a section as in FIG. 2, but during a compacting phase in which detritus is compacted;

FIG. 5 is a view as in FIG. 3, but during a compacting phase in which detritus is compacted;

FIG. 6 is a section as in FIGS. 2 and 4, but during an extraction phase in which compacted detritus is extracted;

FIG. 7 is a view as in FIGS. 3 and 5, but during an extraction phase in which detritus is extracted.

Figure 1:
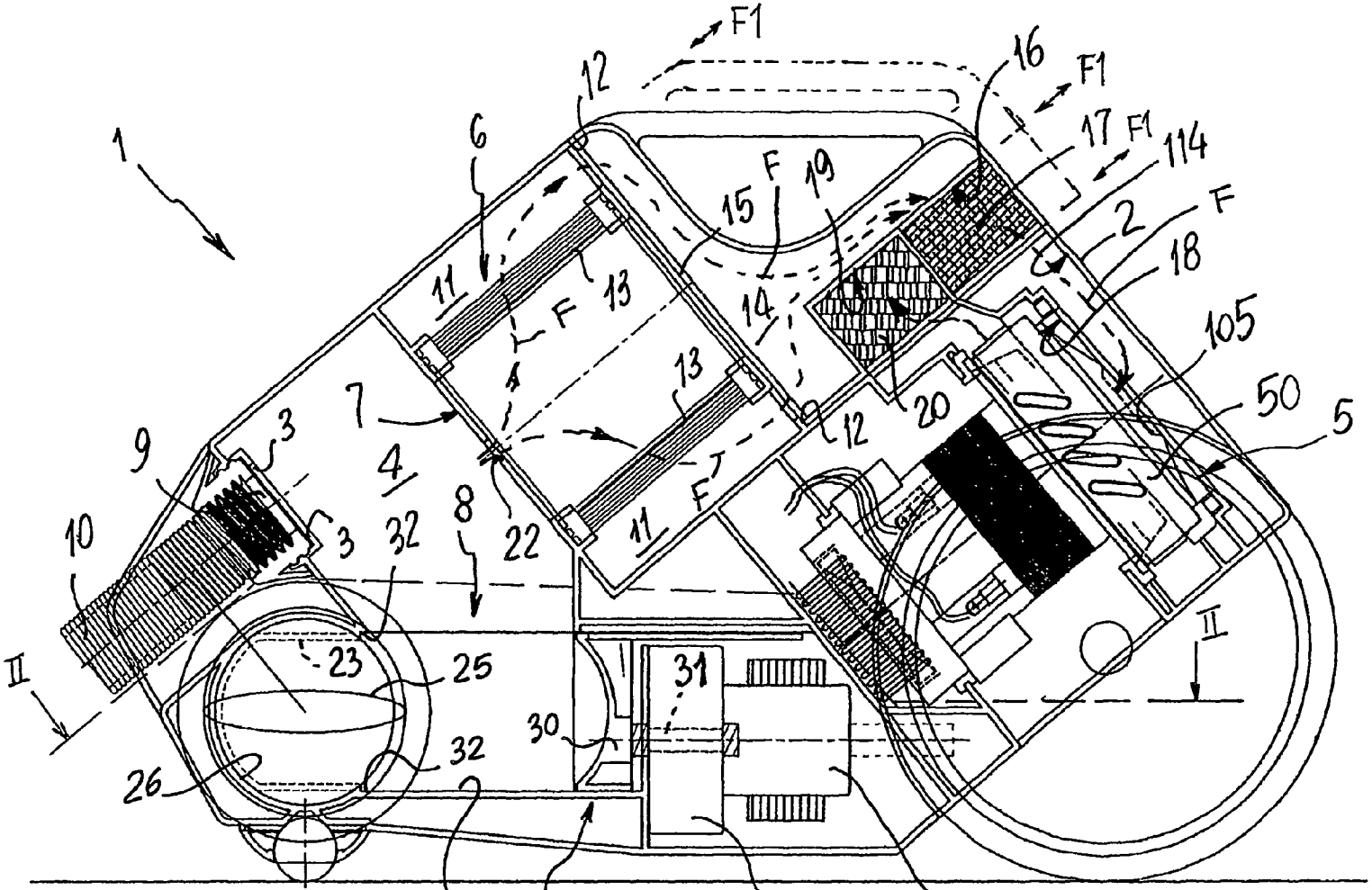
FIG. 1 is a schematic transparent side view of an improved vacuum cleaner.

In the Figures, 1 generally indicates a vacuum cleaner comprising an enclosure body 2, for example shaped as a box, which is provided with at least one aspiration port 3 though which a flow of aspirated matter composed of air and detritus is conveyed.

Within the body 2 at least one chamber 4 is defined for collecting detritus therein, an end of said aspiration port 3 leading out in the chamber 4.

Within the body 2 a sucking unit 5 is housed, including a motor, for supplying the aspiration action, which sucking unit 5 is connected to the port 3 and the collection chamber 4 by a path defined within the body 2.

Adjacent to the collection chamber 4 a filter arrangement 6 is located for purifying the aspirated matter. The filter arrangement 6 comprises a filter element 13 received in a first filter chamber 11.

The collection chamber 4 is internally provided with a barrier 7 located opposite to the aspiration port 3, in such a way that the barrier 7 extends transversally of the flow of aspirated matter.

The barrier 7 separates the collection chamber 4 from the first filter chamber 11.

In use, a dynamic separation between particles of detritus and the air current is achieved, and such particles fall in the lower part of the collection chamber 4 in which removable a member 8, such as a drawer, is provided.

As will be better understood in the following, the removable member 8 is also dedicated to compacting and extraction of collected detritus after separation from the air current.

The aspiration port 3 is provided, at its end projecting outside of the chamber 4, with a fitting 9, consisting, for example, of a section of tubular mouthpiece for sealingly coupling with the corresponding end of an extension pipe 10 of the conventional type.

The barrier 7 has one or more openings, such as microperforations 22, according to the air flow, communicating the collecting chamber 4 with the first filter chamber 11.

The first filter element 13 has the shape of a concave cylinder, and the openings 22 are located substantially centrally of a longitudinal axis thereof.

In the body 2, a second filter chamber 14 is also defined that is located adjacent and downstream of the first filter chamber 11: between the filter chamber 11 and the second filter chamber 14 a common perforated wall 15 is arranged.

The perforated wall 15 is provided with apertures 12 located in an annular region externally of the filter element 13.

In this way, air current coming from the openings 22 moves in both an axial and radial directions as shown by arrow F to the periphery of the first filter element 13 and passes through the apertures 12 to leave the first filter chamber 11.

The second filter chamber 14 has a box-like structure which includes a seat 16 for a second filter element 17, said seat 16 being provided with air passageways, not shown, for flowing of the air current coming from the second filter chamber 14 and directed to a manifold 114 leading to the sucking unit 5.

The second filter chamber 14 is releasably mounted on the body 2 via hooking and unhooking elements, known per se, so that should access to the filter element 13 be required, for example for replacement thereof, the second filter chamber 14 can be removed in the direction indicated by arrows F1.

Within the body 2, an exit chamber 18 is defined in which a housing 50 of sucking unit 5 is mounted, the exit chamber 18 being provided with a further seat 19 for a further filter element 20 by which air current leaving the vacuum clean is finally filtered.

The sucking unit 5 is centrally communicating with the manifold 114 and is peripherally communicating with the housing 50.

The extraction device 8 of the detritus "D" comprises a boxed tank, such as a drawer 23, in particular having a bottom provided with a transversal cross-section with a rounded shape according to a cylindrical profile, which is provided with at least one loading opening 24 and which can be rotated by acting on a handling element, for example a handle 25, between a loading position and an extraction position; the boxed tank 23 is positioned at a height below the internal end of the aspiration port 3.

The boxed tank 23 is accommodated in an appropriate housing and guide seat 26, both in an axial and rotational direction, which is defined in the collection chamber 4, in particular at the base thereof.

A pusher unit 27 is also provided for pushing the collected detritus from the collection chamber 4 to inside of the boxed tank 23; the pusher unit 27 is reciprocatable by a motor arrangement 28 fixed around said body 2 and is slidable on a sliding surface 29 that connects a threshold of the housing and guide seat 26 with the fitting zone of said motor arrangement 28.

The pusher unit 27 comprises a shaped buffer 30 that, in a transversal cross-section, fits with the perimeter of the loading opening 24, in such a way as to completely occupy it, when, as illustrated in FIG. 4, the pusher unit 27 has completed an active pushing stroke of the detritus "D" collected in the collection chamber 4.

The pusher unit 27 further comprises a transmission unit 28*a*, 31 interposed between the shaped buffer 30 and said motor arrangement 28.

The boxed tank 23 is received axially and rotationally into the guide seat 26 having a concave cylindrical shape; furthermore, the guide seat 26 has a slit 32 for the passage of the detritus "D", which slit is facing the shaped buffer 30.

As already stated previously, the boxed tank 23, the housing and axial and rotational guide seat 26 and the shaped buffer 30 have longitudinal axes that are parallel to one another and are transversal to the direction of the flow of aspirated matter. The invention operates as follows: the aspirated matter enters the collection chamber 4 through the aspiration port 3, normally equipped with the extension pipe 10, breaks against the dynamic separation barrier 7 located transversally: the blow against the latter divides the air from the detritus "D" making the latter precipitate to the bottom of the collection chamber 4, said detritus "D" accumulating on the sliding surface 29 of the pusher unit 27, and enabling the air to move, through the through microperforations 22 towards the suction unit 5, passing though a path comprising the first filter chamber 11 and the first filter element 13, the second filter chamber 14 and the second filter element 17 and third filter element 20 of the exit chamber 18, passing through the sucking unit 5.

Along this path, the air current is subjected to a first purification of the impurities from the first filter element 13, a second purification through the second filter element 17, and a third purification through the further filter element 20, before being pushed towards the exterior and being readmitted into the environment.

During the aspiration phase, the pusher unit 27 keeps the shaped buffer 30 retracted towards the motor arrangement 28 or gearmotor 28*a* so that the detritus "D" that precipitate after the blow against the dynamic separation barrier 7 accumulate on the sliding surface 29, which constitutes the actual bottom of the collection chamber 4.

When the detritus "D" has reached a set volume, the motor arrangement 28 is actuated which, through the transmission element 31, for example a worm screw 33, progressively pushes it towards the boxed tank 23, sliding with the detritus "D" along the sliding surface 29.

The boxed tank 23 is arranged, in the loading configuration of the detritus "D", rotated in its housing and axial and rotational guide seat 26 facing the shaped buffer 30: in this configuration, said loading opening 24 and the slit 32 are aligned on each other in such a way as to enable the passage of the detritus "D" directed towards the inside of the boxed tank 23.

The pusher unit 27 completes its action when the shaped buffer profile 30 is coupled at the end of the active stroke with the loading opening 24, completing its transversal cross section, as shown in FIG. 4.

The detritus "D" is then compacted inside the boxed tank 23, which, as soon as the pusher unit 27 starts its return stroke, can be rotated from the outside by means of the handle 25, in such a way as to bring the loading opening 24 to the top: in this configuration, the boxed tank 23 can then be extracted as a drawer from its seat 26, emptied and replaced to be again rotated towards the pusher unit 27 and repositioned in the loading configuration.

To perform the operations of normal and periodical maintenance and cleaning of the improved vacuum cleaner 1 and to conserve their maximum operating efficiency, the filter elements 13, 17 and 20 are dismantled, cleaned and refitted.

To perform this task, the second filter chamber 14 is removed from its seat by unhooking it from the boxed body 2; said second space carries the common wall 15 that is integral therewith and its removal frees an access opening 12 to the first filter chamber 11, and consequently to the first filter element 13, which can be extracted, cleaned and put back inside the first filter chamber 11.

The second filter element 17 and the further filter element 20 can also be extracted from their respective first seat 16 and further seat 19, and can be cleaned and reinserted therein.

Said second filter chamber 14 is then relocated in its work position and rehooked to the boxed body 2 with per se prior-art hooking and unhooking elements: in this way, the total operating efficiency of the improved vacuum cleaner 1 is restored through simple, easy and economic operations, it being necessary to proceed with the complete replacement of said first 13, second 17 and further filter elements 20 only after numerous cycles of use and cleaning thereof.

The invention claimed is:

1. Vacuum cleaner comprising:

a collection chamber located along an intended path through which air current and detritus is conveyed, said collection chamber being provided with a collection zone in which said detritus is receivable, wherein said collection chamber is provided with a compacting device movable across said collection zone for compacting said detritus, said collection chamber including a boxed tank slidably received in a receiving seat provided within the vacuum cleaner, wherein, along said intended path, a filter chamber arrangement is provided housing a filter arrangement for filtering said air current, and wherein said filter chamber arrangement comprises a first filter chamber adjacent to said collection chamber and communicating with said collection chamber through an opening arrangement of a barrier.

2. Vacuum cleaner according to claim 1, wherein said filter chamber arrangement comprises a second filter chamber adjacent to said first filter chamber, and communicating with said first filter chamber through an aperture of a common wall.

3. Vacuum cleaner according to claim 2, wherein said filter chamber arrangement comprises an exit chamber adjacent to said second filter chamber, and communicating with said second filter chamber through a housing of a sucking unit.

4. Vacuum cleaner comprising:

a collection chamber located along an intended path through which air current and detritus is conveyed, said collection chamber being provided with a collection zone in which said detritus is receivable, wherein said collection chamber is provided with a compacting device movable across said collection zone for compacting said detritus, said collection chamber including a boxed tank slidably received in a receiving seat within the vacuum cleaner, wherein said compacting device comprises a pusher unit having a buffer so driven as to compact said detritus in said boxed tank, and wherein said boxed tank is rotatably received in said seat so that said boxed tank can be rotated between an extracting position, in which a loading opening faces upwards, and a loading position in which said loading opening faces said pusher unit.

5. Vacuum cleaner comprising:

a collection chamber located along an intended path through which air current and detritus is conveyed, said collection chamber being provided with a collection zone in which said detritus is receivable, wherein said collection chamber is provided with a compacting device movable across said collection zone for compacting said detritus, said collection chamber including a boxed tank slidably received in a receiving seat within the vacuum cleaner, wherein said compacting device comprises a pusher unit having a buffer so driven as to compact said detritus in said boxed tank, and wherein said buffer is so shaped as to shapingly fit with a slit of said seat.

6. Vacuum cleaner comprising:

a collection chamber located along an intended path through which air current and detritus is conveyed, said collection chamber being provided with a collection zone in which said detritus is receivable, wherein said collection chamber is provided with a compacting device movable across said collection zone for compacting said detritus, said collection chamber including a boxed tank slidably received in a receiving seat within the vacuum cleaner, and wherein said seat has a substantially cylindrical shape for snugly accommodating said boxed tank.

7. Vacuum cleaner according to claim 6, wherein said boxed tank and said seat have a common longitudinal axis.

8. Vacuum cleaner according to claim 7, wherein said common longitudinal axis is transversely disposed of a longitudinal axis of said buffer.

9. Vacuum cleaner, comprising a collection chamber located along an intended path through which air current and detritus is conveyed, said collection chamber being provided with a collection zone in which said detritus is receivable, wherein said collection chamber is provided with a barrier positioned transversally of a flow direction of said air current and detritus, wherein along said intended path, a filter chamber arrangement is provided housing a filter arrangement for filtering said air current, and wherein said filter chamber arrangement comprises a first filter chamber adjacent to said collection chamber and communicating with said collection chamber through an opening arrangement of said barrier.

10. Vacuum cleaner according to claim 9, wherein said filter chamber arrangement is releasably fitted to an enclosure arrangement.

11. Vacuum cleaner according to claim 9, wherein said filter chamber arrangement comprises a second filter chamber adjacent to said first filter chamber, and communicating with said first filter chamber through an aperture of a common wall.

12. Vacuum cleaner according to claim 11, wherein said filter chamber arrangement comprises an exit chamber adjacent to said second filter chamber, and communicating with said second filter chamber through a housing of a sucking unit.

* * * * *